US007457204B1

(12) United States Patent
Winters

(10) Patent No.: US 7,457,204 B1
(45) Date of Patent: Nov. 25, 2008

(54) ALARM CLOCK WITH AM/FM RADIO, CD PLAYER, PORTABLE AUDIO STORAGE DEVICE DOCKING INPUT, BATTERY BACKUP, AND KEYPAD WITH FOLDING COVER

(76) Inventor: Bradley Winters, 2501 Burl Oaks Curve, Hudson, WI (US) 54016

( * ) Notice: Subject to any disclaimer, the term of this patent is extended or adjusted under 35 U.S.C. 154(b) by 0 days.

(21) Appl. No.: 11/784,285

(22) Filed: Apr. 6, 2007

(51) Int. Cl.
*G04B 23/04* (2006.01)

(52) U.S. Cl. ..... 368/73; 368/286; 368/10

(58) Field of Classification Search ..... 368/73, 368/286, 10
See application file for complete search history.

(56) References Cited

U.S. PATENT DOCUMENTS 4,149,257 A 4/1979 Nakagiri et al.
4,301,524 A * 11/1981 Koepp et al. ..... 368/261
D268,758 S 4/1983 Boldt et al.
4,868,800 A 9/1989 Arber
5,365,494 A * 11/1994 Lynch ..... 368/10
5,457,664 A * 10/1995 Izukawa et al. ..... 368/80
5,883,859 A 3/1999 Bentley
6,795,377 B2 * 9/2004 Gorden ..... 368/12
2004/0151076 A1 * 8/2004 Fidel ..... 368/251
2006/0071801 A1 4/2006 Chipchase

* cited by examiner

*Primary Examiner*—Felix O. Figueroa
*Assistant Examiner*—Sean Kayes

(57) ABSTRACT

The invention is an alarm clock with a keypad for setting the time as well as the time for the alarms. The alarm clock also has a keypad cover that when placed over the keypad will prevent the accidental depression of the time setting keys of the keypad. The alarm clock also has an integrated CD player, an integrated AM/FM clock, an integrated docking port for portable audio storage devices. The alarm clock also contains a plurality of buttons located on the top of the alarm clock for providing a snooze feature, a dimming feature for the time display, The alarm clock also features a backup battery storage compartment, which provides backup power in the event that the AC electrical power provided by the electrical cord is no longer available. The alarm clock also comes with a remote control that enables the user to operate the CD player as well as the volume.

1 Claim, 2 Drawing Sheets

ALARM CLOCK WITH AM/FM RADIO, CD PLAYER, PORTABLE AUDIO STORAGE DEVICE DOCKING INPUT, BATTERY BACKUP, AND KEYPAD WITH FOLDING COVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of alarm clocks, more specifically, an alarm clock with a protected key pad.

B. Prior Art

The Gorden patent (U.S. Pat. No. 6,795,377) discloses an alarm clock with a keypad for use in programming multiple features of the clock and also includes a coupling station for a music storage device. However, this patent does not disclose a keypad that enables the user to control, among other things, the time and be able to cover the keypad with a cover for use in the prevention of accidental key depression, which may result in an accidental change in the time presented on the screen.

The Chipchase Patent Application Publication (U.S. Pub. No. 2006/0071801) discloses an alarm clock with a keypad for user input. However, the keypad in this patent does not have an enclosure and cover from which to protect the keypad from accidental key depression.

The Nakagiri et al. patent (U.S. Pat. No. 4,149,257) discloses an alarm watch with a calculator key pad. However, the alarm clock on this patent does not disclose an integrated CD player, a docking port for audio memory storage devices, an integrated AM/FM radio, nor does it disclose a keypad with a cover in order to prevent accidental key depression.

The Bentley patent (U.S. Pat. No. 5,883,859) discloses an alarm clock with a lockable key pad for programming the clock's features. However, this patent does not disclose many other features such as an integrated CD player, an integrated AM/FM radio, a portable audio memory storage device, nor a battery backup.

The Koepp et al. patent (U.S. Pat. No. 4,301,524) discloses a programmable alarm clock with a 10 digit keypad for user input. However, the alarm clock claimed in this patent does not contain any other features such as a keypad cover for the prevention of accidental key depression, an integrated CD player, an integrated AM/FM radio, an integrated portable audio memory storage device, or a battery backup.

The Arber patent (U.S. Pat. No. 4,868,800) discloses a date and time warning system with a keypad for inputting information into the device. However, this device does not function like a traditional alarm clock.

The Boldt et al. patent (U.S. Pat. No. Des. 268,758) illustrates an alarm clock with a keypad.

BRIEF SUMMARY OF THE INVENTION

The invention is an alarm clock with a keypad for setting the time as well as the time for the alarms. The alarm clock also has a keypad cover that when placed over the keypad will prevent the accidental depression of the time setting keys of the keypad. The alarm clock also has an integrated CD player, an integrated AM/FM clock, an integrated docking port for portable audio storage devices. The alarm clock also contains a plurality of buttons located on the top of the alarm clock for providing a snooze feature, a dimming feature for the time display, The alarm clock also features a backup battery storage compartment, which provides backup power in the event that the AC electrical power provided by the electrical cord is no longer available. The alarm clock also comes with a remote control that enables the user to operate the CD player as well as the volume.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
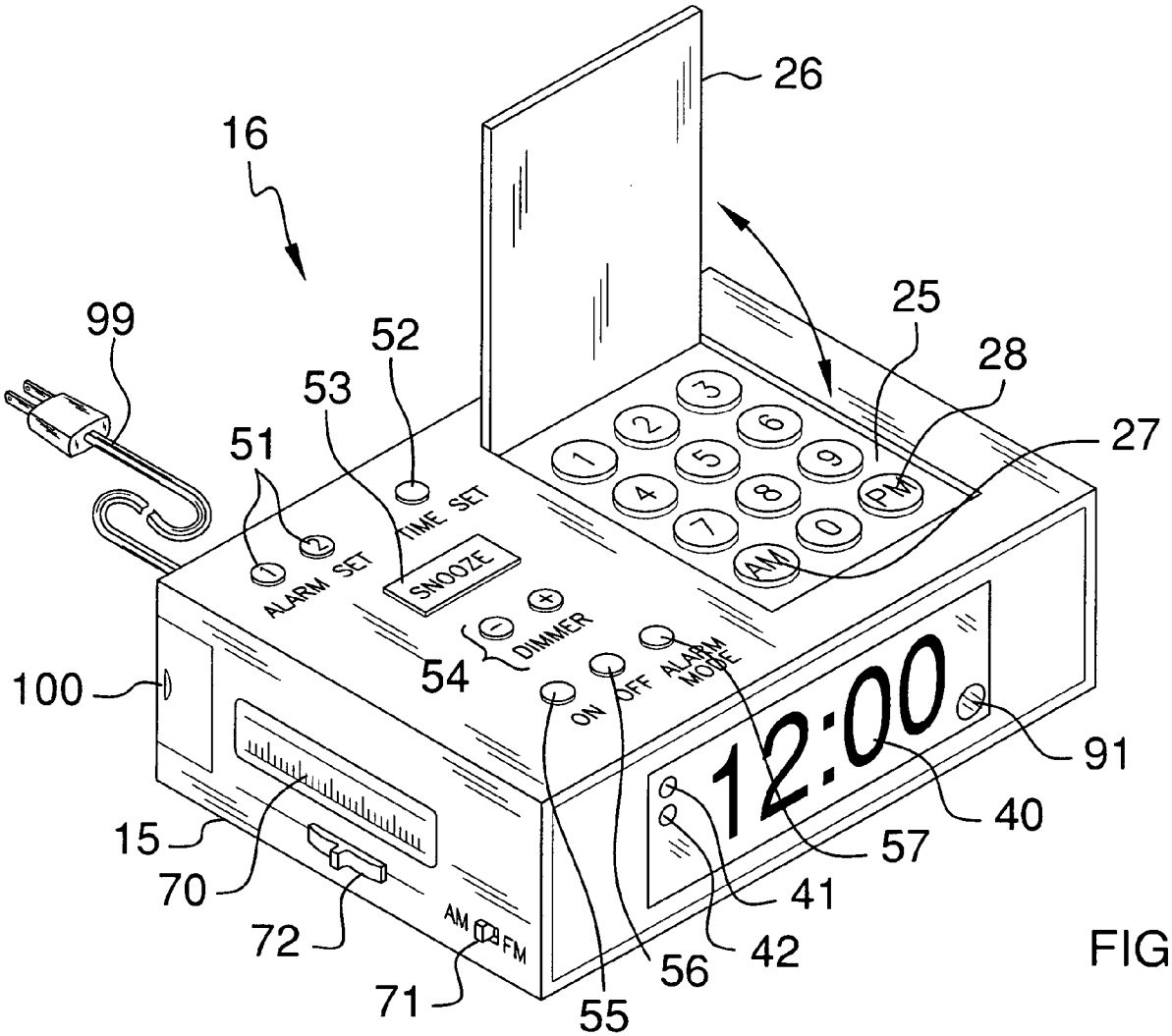
FIG. 1 illustrates a front-left isometric view of the invention with the keypad cover in the open position.
Figure 2:
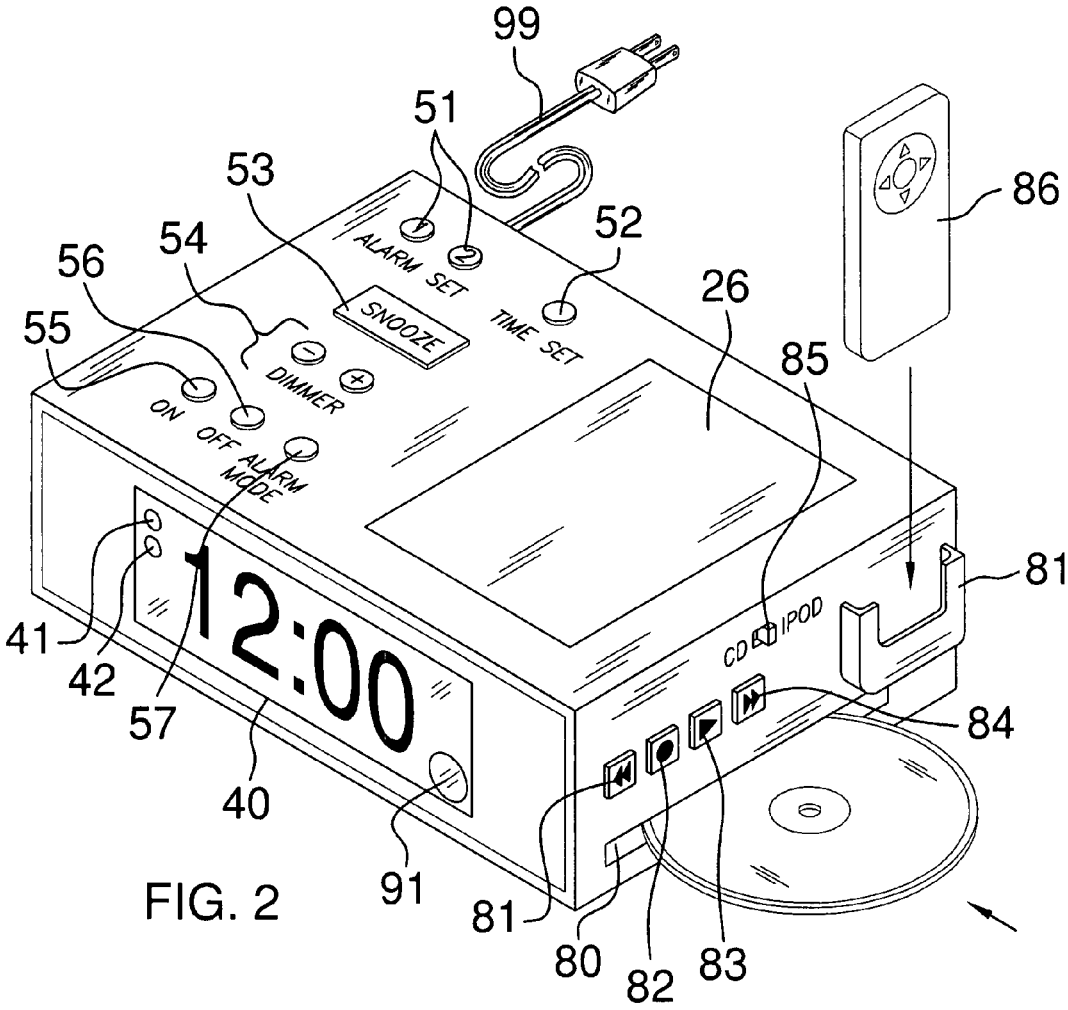
FIG. 2 illustrates a front-right isometric view of the invention with the keypad cover in the closed position.
Figure 3:
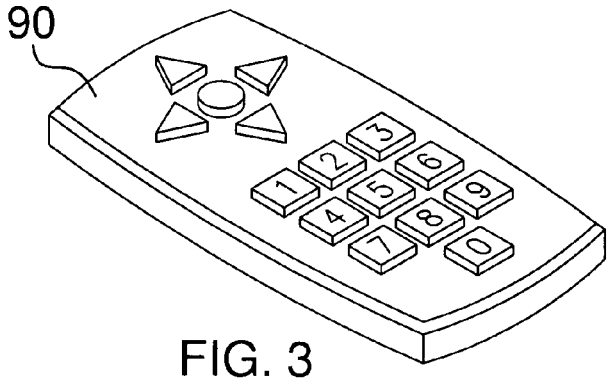
FIG. 3 illustrates the remote control provided with the alarm clock.

Detailed reference will now be made to the preferred embodiments of the present invention, examples of which are illustrated in FIGS. 1-3. The invention 10 comprises an alarm clock 15 that includes a keypad 25 located on the top side of the alarm clock 15. The keypad 25 has a corresponding keypad cover 26, which folds down to cover the keypad 25 from accidental button depression. The keypad 25 contains an "AM" button 27, a "FM" button 28, as well as buttons numbered "0" through "9."

The alarm clock 15 has a time display 40, which is located on the front of the alarm clock 15. The time display 40 has an alarm one indication light 41 located on the front right corner of the time display 40. The alarm one indication light 41 illuminates when the alarm for alarm one is set on the alarm clock 15, which will play sound from an AM/FM radio 70.

The alarm clock 15 has an alarm two indication light 42 that illuminates when an alarm is set on alarm two, which will play sound from either a CD player 80 or a portable audio storage device 86.

The end user has the option to select both an alarm one and an alarm two in that both the alarm one indication light 41 and the alarm two indication light 42 are illuminated. This advantage enables a couple or single end user to set multiple alarms to go off at different times, which provides more versatility to the alarm clock 15.

To set an alarm, the end user will depress and hold down one of the two alarm set buttons 51. While holding down the desired alarm set button 51, the end user will dial in the desired time on the keypad 25 along with the designation of either AM or PM via keys 27 and 28. Once the desired alarm time is set, the end user will release the alarm set button 51.

To set the time, the end user will depress and hold down the time set button 52 while dialing in the desired time on the keypad 25 along with the designation of either AM or PM via keys 27 and 28. Once the desired time is set, the end user will release the time set button 52.

A snooze button 53 located on the top surface of the alarm clock 15 provides the end user with the option of taking a snooze when either of the alarms go off. Located on the top surface of the alarm clock 15 is a set of dimmer buttons 54, which either brighten or dim the time display 40 so as to adjust the amount of light being emitted. The dimming feature enables those who have difficulty sleeping with light surrounding them the option to minimize said light to a preferable level.

Located on the top surface of the alarm clock 15 is an "ON" button 55, which cycles on the AM/FM radio 71, the CD player 80, or the portable audio storage device 86. Located next to the "ON" button, is an "OFF" button 56, which when depressed turns off all sound playing from the speaker (not shown).

An "ALARM MODE" button 75 is located near the "OFF" button, which cycles through both alarms one and two, and indicates via the corresponding alarm light indication lights 41 and 42 located on the display screen 40 if alarm one or alarm two, or both are set.

The alarm clock 15 has located on the left side the AM/FM radio 70, which includes an AM/FM designation switch 71, and a tuning knob 72.

The alarm clock 15 has located on the right side an integrated CD player 80 with a previous track button 81, a stop button 82, a play button 83, and a next track button 84. A CD/Dock designation switch 85 enables the end user to designate either the CD player or a portable audio storage device 86 to play music. The portable audio storage device 86 connects to the alarm clock 15 by an input dock 87.

A remote control 90 can control the functions of the CD player 80 as well as the volume coming from a speaker (not shown). The remote control 90 transmits an infrared signal to the alarm clock infrared receiver 91, which is located on the time display 40.

Protruding from the rear of the alarm clock 15 is a power cord 99, which supplies AC current to the alarm clock 15 when plugged into a traditional power outlet (not shown). Located on the left-rear side of the alarm clock 15 is a battery backup compartment 100. The backup battery compartment 100 provides emergency backup power to the alarm clock 15 when the power cord 99 is accidentally unplugged or is not receiving AC current from the standard wall outlet (not shown).

The invention claimed is:

1. An alarm clock comprising:

(a) a keypad that is located on the top surface of the alarm clock;

wherein the elevation of the keypad is lower than the top surface of the alarm clock;

wherein a keypad cover folds down and covers the keypad when not in use in order to prevent the accidental depression of keys;

wherein the keypad contains keys for the numbers "0" through "9", as well as an "AM" key, and a "PM" key;

(b) a display screen;

wherein both an alarm one indication light and an alarm two indication light are located in a predetermined location on the display screen, and are illuminated when either or both of the two alarms are set via an "ALARM MODE" button;

wherein an infrared signal receiver is located on the display screen, and enables the alarm clock to be operated by a remote control;

(c) an AM/FM radio;

wherein the AM/FM radio is located and controlled from a side of the alarm clock;

wherein a tuning dial with the corresponding frequency is provided in order to tune into the desired frequency;

wherein an AM/FM designation button is located next to the tuning dial (d) a battery backup compartment is located on the alarm clock and provides backup power to the alarm clock when the traditionally provided form of electrical current stops;

(e) a power cord protrudes from the rear of the alarm clock and plugs into a traditional wall outlet in order to provide a continuous supply of AC electrical current;

(f) located on a side of the alarm clock is a CD player;

wherein a plurality of buttons located immediately adjacent to the CD player provide the end user with an opportunity to adjust the track, stop or play the CD (g) a CD or portable audio storage device designation switch is located on the same side where the CD player is located, and enables the end user an opportunity to designate whether music is to be played from either the CD player or the portable audio storage device;

(h) a speaker is located on the alarm clock and plays signals from either the AM/FM radio, CD player, or a portable audio storage device;

(i) a portable audio storage device dock is located on a predetermined surface of the alarm clock and can play music provided the portable audio storage device is compatible with the dock;

(j) a snooze button is located on a surface of the alarm clock;

(k) an up dimmer button and a down dimmer button are located on a surface of the alarm clock;

(l) an ON button is located on a surface of the alarm clocks wherein the ON button cycles through input signals generated by the AM/FM radio, CD player, and the portable audio storage device;

(m) an OFF button is located on a surface of the alarm clock;

wherein the OFF button, when depressed, stops all music from playing through the speaker;

(o) the ALARM MODE button, is located on a surface of the alarm clock;

wherein the ALARM MODE button, when depressed, cycles through the available options of turning on alarm one only, turning on alarm two only, turning on both alarm one and alarm two, or turning off both alarm one and alarm two;

(p) a TIME SET button is located on a surface of the alarm clock;

wherein the time presented on the time display can be adjusted by depressing and holding the TIME SET button while keying in the time on the keypad and designating whether it is AM or PM; and (q) an ALARM ONE button and an ALARM TWO button are located on a surface of the alarm clock; and wherein the desired time to set for either alarm one or alarm two is set by depressing and holding the desired alarm button down, and simultaneously keying the desired time on the keypad and designating whether the time to set is for either the AM or PM.

* * * * *